United States Patent [19]

Jaume

[11] Patent Number: 4,862,137

[45] Date of Patent: Aug. 29, 1989

[54] ELECTRIC HEATING DEVICE HAVING A METAL SHEATH

[75] Inventor: Richard Jaume, Moret sur Loing, France

[73] Assignee: Electricite De France, Paris, France

[21] Appl. No.: 66,443

[22] Filed: Jun. 26, 1987

[30] Foreign Application Priority Data

Jun. 26, 1986 [FR] France ..... 86 09274

[51] Int. Cl.[4] ..... H01C 1/03

[52] U.S. Cl. ..... 338/237; 219/374

[58] Field of Search ..... 338/237, 248, 250, 269, 338/275; 219/374, 375, 378, 367, 381, 382

[56] References Cited

U.S. PATENT DOCUMENTS

| | | | |
|---|---|---|---|
| 2,917,814 | 12/1959 | Ruckelshaus | 338/237 X |
| 3,835,296 | 9/1974 | Middough et al. | 338/237 X |
| 4,412,126 | 10/1983 | Brockway | 219/553 |
| 4,536,642 | 8/1985 | Hamster et al. | 219/374 |

FOREIGN PATENT DOCUMENTS

| | | |
|---|---|---|
| 759476 | 11/1933 | France . |
| 815239 | 4/1937 | France . |
| 2413011 | 7/1979 | France . |
| 2559886 | 2/1984 | France . |

*Primary Examiner*—E. A. Goldberg
*Assistant Examiner*—M. M. Lateef
*Attorney, Agent, or Firm*—Fleit, Jacobson, Cohn, Price, Holman & Stern

[57] ABSTRACT

A resistance heating device having a longitudinal axis and a substantially cylindrical graphite heating element with a connecting part for connection to an electric power source. The device has a sheath surrounding the graphite heating element, radially spaced therefrom and defining a gas tight chamber about the graphite heating element, the sheath being made from a refractory alloy sheet having angularly distributed longitudinal corrugations and an internal surface arranged to directly receive over its whole area radiation emitted by the graphite heating element when energized.

12 Claims, 2 Drawing Sheets

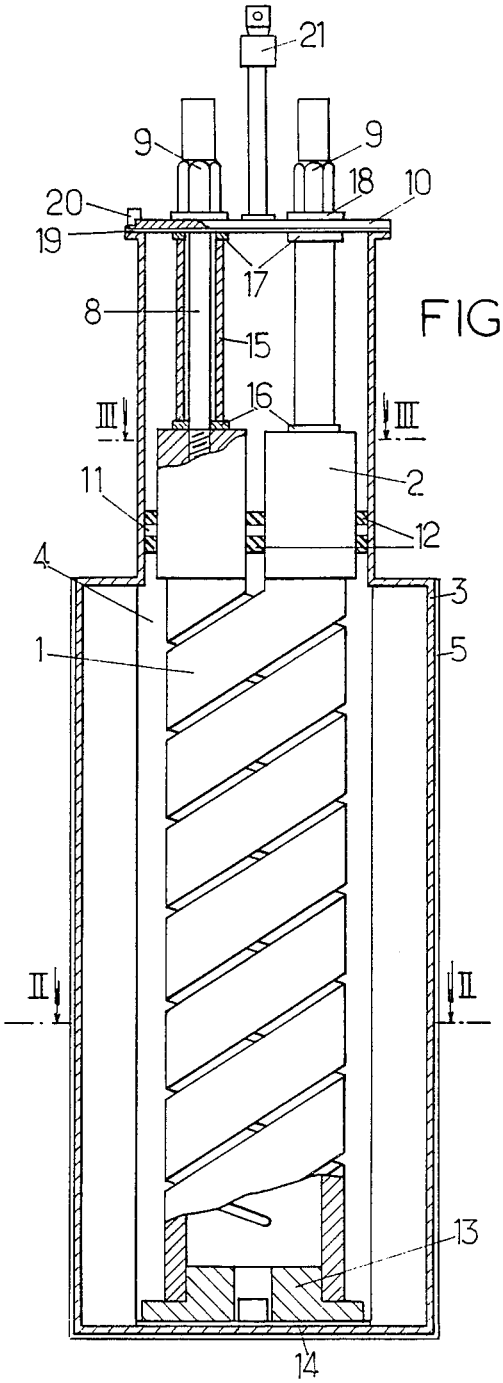
FIG.1.
FIG.2.
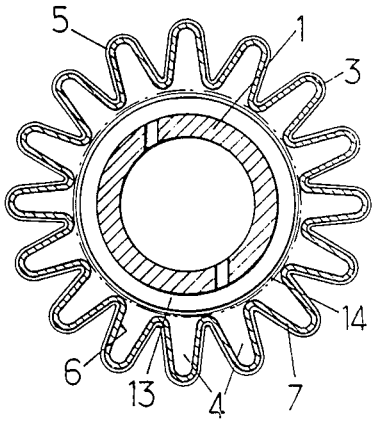

ELECTRIC HEATING DEVICE HAVING A METAL SHEATH

BACKGROUND OF THE INVENTION

The invention relates to electric resistance heating devices of the type having an elongate, substantially cylindrical, graphite heating element surrounded by a refractory material sheath defining, about the heating element, a gas tight chamber for retaining the carbon monoxide formed during the first temperature rise of said heating element.

The invention is particularly suitable (though not exclusively) for electrical heating devices permitting to reach in furnaces having corrosive and oxidizing atmospheres, temperatures as high as those obtained when using a fossil fuel.

Electrical heating devices of the above defined type are already known. In particular, in the French patent application FR-A-No. 84 02358, the applicant describes a device having a graphite heating element protected against oxidation by an atmosphere containing carbon monoxide produced by the heating element itself during the first use of the device and surrounded by a tubular corrosion resistant refractor ceramic sheath. This solution overcomes numerous problems.

However, the use of a ceramic sheath, whose thermal conductivity is low, limits the power which may be dissipated per unit surface by the device.

SUMMARY OF THE INVENTION

It is an object of the invention to provide an improved electric heating device. It is a more particular object of the invention to provide a device with a sheath having a form particularly suitable for diffusion of the radiant heat radiating from the graphite heating element, said form being impossible to adopt with a ceramic sheath whose shape is limited to a cylinder of revolution or an oval. Very high thermal or heating powers may thus be dissipated per unit of surface without limitation of the size of the environment heated by such a device. The cost price of such a device is moreover lower, and the resistance to thermal shocks is greatly improved.

For that purpose, it is an object of the invention to provide a resistance heating device having a longitudinal axis and comprising:

a substantially cylindrical graphite heating element having means for connection to an electric power source, and a sheath surrounding said graphite heating element, radially spaced therefrom and defining a gas tight chamber about said graphite heating element, said sheath being made from a refractory oxidation resisting alloy sheet having angularly distributed longitudinal corrugations and an internal surface arranged to directly receive over its whole area radiation emitted by the graphite heating element when energized, whereby said gas tight chamber is for sealingly retaining carbon monoxide upon oxidation of said graphite heating element.

It is another object of the invention to provide a resistance heating device having a longitudinally axis and comprising:

a substantially cylindrical graphite heating element having means for connection to an electric power source, and a sheath surrounding said graphite heating element, radially spaced therefrom and defining a gas tight chamber about said graphite heating element, said sheath being made from a refractory alloy sheet coated with an external metal protective layer of substantially constant thickness and having angularly distributed longitudinal corrugations and an internal surface arranged to directly receive over its whole area radiation emitted by the graphite heating element when energized.

The invention also provides a device wherein the sheath internal surface is substantially parallel to the longitudinal axis of the heating device, the sheath internal surface has a generatrix which is a helic having for axis the longitudinal axis of the device, therefore inducing a generally substantially spiral shape for the sheath, the sheath is radially disposed arround said longitudinal axis and has a developed circumference 1.5 to 5 times longer than the circumference of the circle circumscribing the summits of the corrugations which extend in the direction of the graphite elements, the refractory alloy is stainless steel and the external metal protective layer is an aluminum chromium deposit, the external metal protective layer is a thin alumina film, the external metal protective layer contains a catalyst for a reaction taking place in an environment in which the heating device is disposed, and the refractory metal alloy is iron-chromium-aluminum alloy.

Generally, this device can be used in any fluid heating process. But it is more particularly advantageous when used in fluidized bed furnaces or reactors. In fact, with the electric devices described in the invention, and this without limiting the size of the reactor which may then have installed powers of several tens of MW, it is possible to deliver 500 kw per $m^3$ of dense phase in a fluidized environment at 900° C., or to deliver a higher power if the temperature of the environment is lower. Powder products whose particles have a diameter greater than about 60 $\mu$m are for the most part fluidizable, although other criteria may limit the possible uses of the process.

Applications of a device according to the invention are nevertheless numerous and diversified. Among them may be mentioned: decarbonation, calcination, pyrolysis, solvent elimination, chemical catalysis, chemical reaction taking place at less than 900° C., etc. In an advantageous embodiment, the above described device is used in a fluidized bed decarbonation reactor.

BRIEF DESCRIPTION OF THE DRAWINGS

The invention will be better understood from reading the following description of a particular embodiment, given by way of non limitative example. The description refers to the accompanying drawings in which:

FIG. 1 is a front view partly in section of the heating device of the invention, FIG. 2 is a section view through II—II of FIG. 1.

DETAILED DESCRIPTION OF THE INVENTION

Figure 3:
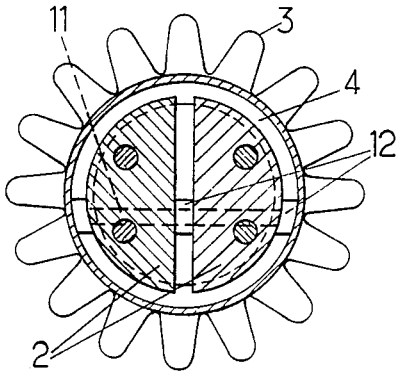
FIG. 3 is a section view through III—III of FIG. 1.

FIG. 1 shows an electric heating device according to the invention, having an elongate graphite heating element 1 of a generally substantially cylindrical shape. More precisely, the element 1 has a heating part having a double helical shape, and is provided with two solid portions 2 at one of its ends having means such as electric connections or plugs screwed into each of said portions and for connection to an electric power source. One of the solid parts is an inlet for the energizing current and the other is the outlet. The double helix of the heating part increases the electric path and therefore increases the resistance of the heating element. In addition, the resistance may be arranged to correspond to the precise needs of a particular utilization or to imposed requirements, such for example as a predetermined and imposed size for the whole heating element or a maximum permissible voltage. Such an arrangement is easily obtained by adjusting the different parameters of the helix (pitch, length and thickness of the helical part, mean diameter). The graphite element is surrounded by a sheath 3 defining, about the heating element 1, a gas tight chamber 4 for sealingly retaining the carbon monoxide formed during the first energization of the element. The sheath is made from a refractory metal alloy sheet resisting the corrosion of the environment in which it is disposed i.e. oxidation, reduction, abrasive attack, and may be covered with an external protective layer 5 of substantially constant thickness. The sheath presents regular corrugations such as shown in FIGS. 2 and 3. These corrugations are disposed so that the internal surface 6 of the sheath "sees" the heating element 1 directly whereby the exchange surface 7 of the device with the environment is increased. In other words, the corrugations are arranged to receive directly, i.e. through a direct radiating path, on all points of their internal surface (i.e. their surface directed toward the graphite heating element), the thermal radiations emitted by the energized graphite. The ratio between the developed circumference of the circle of the sheath and the circumference of the circle (shown with dot dash lines in FIG. 2) passing through or circumscribing the summits of the corrugations which are in the direction of the axis of the device, is between 1.5 and 5. In the embodiment shown on FIGS. 2–3, the ratio adopted is about 4.

The electric connections of the graphite heating element with the power source are for example four in number (two per solid portion 2). They are each formed by a steel bar 8, threaded at both ends. The bars support and put in positin the graphite element 1, axially and radially, and connect the terminal portions 9 to the solid portions 2 of the heating element 1. The bars 8 have also a role for thermally insulating plate 10 with respect to the heating element 1. To provide four connections or plugs ensures better rigidity of the whole device assembly.

Plate 10 is an asbestos based composite part, which supports the heating element via the bar 8. Plate 10 sealingly closes the device and provides an electric insulation between the four terminal portions 9. By closing the device sealingly, plate 10 allows the carbon monoxide formed in the gas tight chamber 4 to be retained. A tube 11 and three washers 12, resistant to temperatures of the order of 1400° C. and made from a material electrically insulating at these temperatures maintain the two solid portions of heating element 1 at a nominal distance and centers said solid portions in sheath 3. A part 13 which must also withstand high temperatures and be electrically insulating, supports and radially maintains the graphite heating element. A centering support 14, in which part 13 is fitted, is secured against rotation and is supported by the bottom of sheath casing 3. Bars 8 are placed in spacer tubes 15, for positioning said bars 8 and distributing the clamping force over the graphite heating element 1 and plate 10. Bearing washers 18 provided with seals also ensure a correct distribution of the clamping force over plate 10 and a good sealing. Since these bearing washers must maintain their properties up to temperatures of the order to 250° C., they are advantageously formed from expanded graphite or an asbestos compound. A seal 10 provides gas tightness between the tube and the plate. It is of metallo-plastic or expanded graphite type for keeping its properties up to temperatures of the order of 400° C. Plate 10 is fixed to sheath 3 by means of screws 20.

A relief valve 21, connected to chamber 4 maintains therein a pressure close to the atmospheric pressure during operation of the device. During such operation, the expanded graphite seals 18 remain subjected to an acceptable temperature, the length of rod 8 being chosen so that this temperature remains of the order of 250° C. During cooling of the device, the gas contained in chamber 4 contracts but the air cannot penetrate. The sheath is therefore subjected to a depression but its mechanical resistance when cold is still sufficient for withstanding the external atmospheric pressure.

A heating device of the above-described type may be advantageously used in a fluidized bed reactor for a decarbonation process. In this case, sheath 3 could be made from an iron-chromium-aluminum alloy of LANTHAL AF type or from a refractory steel protected by a chromium-alumina deposit.

Figure 4:
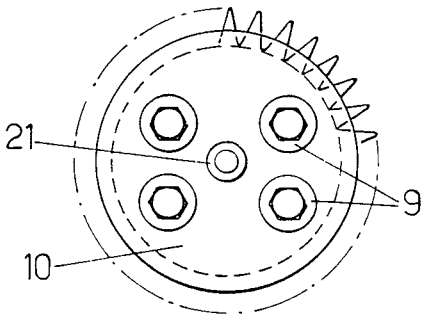
FIG. 4 is a top view of another embodiment of the device of the invention showing a sheath with another type of corrugations or folds than on FIGS. 1, 2 and 3.

The invention is not limited to the embodiments which have been described. It covers all variants thereof and more particularly:

devices having regular corrugations which do not have a rounded form such as shown on FIGS. 2 and 3, but which have sides with acute angles as shown on FIG. 4, devices where these regular corrugations are separated by straight portions having no corrugation, devices where studs or fins are added to the corrugated sheath so as to further increase the thermal exchange thereof with the ambient environment, device intended to be used in fluidized bed reactors for a process other than that of decarbonation, devices of the invention intended to be used for carrying out drying, sludge and residue incineration, and heat treatment operations, devices having sheath which are obtained by bending a metal sheet and closing said sheath on itself by welding.

I claim:

1. A resistance heating device having a longitudinal axis and comprising:

a substantially cylindrical graphite heating element having means for connection to an electric power source, and a sheath surrounding said graphite heating element, radially spaced therefrom and defining a gas tight chamber about said graphite heating element, said sheath being made from a refractory oxidation resisting alloy sheet having angularly distributed longitudinal corrugations and an internal surface arranged to directly receive over its whole area radiation emitted by the graphite heating element when energized, whereby said gas tight chamber sealingly retains carbon monoxide upon oxidation of said graphite heating element.

2. A resistance heating device having a longitudinal axis and comprising:

a substantially cylindrical graphite heating element having means for connection to an electric power source, and a sheath surrounding said graphite heating element, radially spaced therefrom and defining a gas tight chamber about said graphite heating element, said sheath being made from a refractory alloy sheet coated with an external metal protective layer of substantially constant thickness and having regular corrugations and an internal surface arranged to directly receive over its whole area radiation emitted through a direct radiating path by the graphite heating element when energized.

3. Heating device according to claim 1, wherein the sheath internal surface is substantially parallel to the longitudinal axis of the heating device.

4. Heating device according to claim 1, wherein the sheath has a generally substantially spiral shape.

5. Heating device according to claim 1, wherein the sheath is radially disposed around said longitudinal axis, the corrugations defining summits extending in the direction of the graphite heating element and has a developed circumference 1.5 to 5 times longer than the circumference of a circle circumscribing said summits.

6. Heating device according to claim 2, wherein the refractory alloy is stainless steel and the external metal protective layer is a aluminum chromium deposit.

7. Heating device according to claim 2, wherein the external metal protective layer is a thin alumina film.

8. Heating device according to claim 2, wherein the external metal protective layer contains a catalyst for a reaction taking place in an environment in which the heating device is disposed.

9. Heating device according to claim 1, wherein the refractory metal alloy is an iron-chromium-aluminum alloy.

10. For electrically heating a fluidized bed in a decarbonation reactor, a resistance heating device having a longitudinal axis and comprising:

a substantially cylindrical graphite heating element having means for connection to an electric power source, and a sheath surrounding said graphite heating element, radially spaced therefrom and defining a gas tight chamber about said graphite heating element, said sheath being made from a refractory alloy sheet coated with an external metal protective layer of substantially constant thickness and having angularly distributed longitudinal corrugations and an internal surface arranged to directly receive on all its points radiation emitted by the graphite heating element when energized.

11. Resistance heating device having a longitudinal axis and comprising:

an elongated graphite heating element of a substantially cylindrical shape having means for connection to an electric power source at an end thereof, and a sheath surrounding said graphite heating element, radially spaced therefrom and defining a gas tight chamber about said graphite heating element, said sheath being of a refractory sheet material which is at least superficially oxidation resistant and having angularly distributed longitudinal corrugations and an internal surface shaped and arranged to directly receive over its whole area radiation from the graphite heating element.

12. Resistance heating device according to claim 11, wherein said corrugations are in the from of rounded folds connected by substantially straight portions of the sheet material.

* * * * *